US010221661B2

(12) United States Patent
Segura

(10) Patent No.: US 10,221,661 B2
(45) Date of Patent: Mar. 5, 2019

(54) PUMP-THROUGH PERFORATING GUN COMBINING PERFORATION WITH OTHER OPERATION

(71) Applicant: Weatherford Technology Holdings, LLC, Houston, TX (US)

(72) Inventor: John W. Segura, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 425 days.

(21) Appl. No.: 14/979,147

(22) Filed: Dec. 22, 2015

(65) Prior Publication Data

US 2017/0175498 A1 Jun. 22, 2017

(51) Int. Cl.
*E21B 43/116* (2006.01)
*E21B 33/12* (2006.01)
(Continued)

(52) U.S. Cl.
CPC ..... *E21B 43/116* (2013.01); *E21B 33/12* (2013.01); *E21B 33/16* (2013.01); *E21B 34/06* (2013.01);
(Continued)

(58) Field of Classification Search
CPC ..... E21B 33/12; E21B 33/16; E21B 34/06; E21B 37/00; E21B 43/116; E21B 43/117; E21B 2034/007
See application file for complete search history.

(56) References Cited

U.S. PATENT DOCUMENTS 2,986,214 A 5/1961 Wiseman et al.
3,211,093 A * 10/1965 McCullough ..... E21B 43/117 175/4.6
(Continued)

FOREIGN PATENT DOCUMENTS

CA 2367753 A1 11/2000
EP 0 931 907 A2 7/1999

OTHER PUBLICATIONS

Smart Completions Ltd., "EXternal Toe Gun," Brochure, undated, obtained from www.smartcompletions.ca on Dec. 8, 2015.
(Continued)

*Primary Examiner* — Matthew R Buck
*Assistant Examiner* — Aaron L Lembo
(74) *Attorney, Agent, or Firm* — Blank Rome LLP

(57) ABSTRACT

In servicing a wellbore having casing cemented therein, an assembly deploys on tubing (coiled tubing or jointed pipe) downhole. Fluid is circulated down the tubing to the assembly, and a perforating gun on the assembly passes the circulated fluid through it. A tool downhole on the assembly is then operated with the circulated fluid passed through the perforating gun. For example, the tool can include a fluid-operated motor and milling tool. To allow the fluid to flow through the gun, an outer housing supports the load between the tubing and operable tool and has an inner flow tube disposed therein. Charges for perforating are supported in the space between the housing and flow tube. Once cleanup or other service is done with the tool, a detonation is initiated for the perforating the casing with one or more charges of the perforating gun. The detonation can be initiated by a deployed device or ball shifting a sleeve to drive a pin into a detonator. Detonating cord can connect the detonation to the charges.

25 Claims, 7 Drawing Sheets

(51) Int. Cl.

| | |
|---|---|
| ***E21B 34/06*** | (2006.01) |
| ***E21B 37/00*** | (2006.01) |
| ***E21B 33/16*** | (2006.01) |
| ***E21B 43/117*** | (2006.01) |
| *E21B 34/00* | (2006.01) |

(52) U.S. Cl.
CPC ..... *E21B 37/00* (2013.01); *E21B 43/117* (2013.01); *E21B 2034/007* (2013.01)

(56) References Cited

U.S. PATENT DOCUMENTS

| | | | | | |
|---|---|---|---|---|---|
| 3,409,081 | A * | 11/1968 | Brown | E21B 10/64 | 166/285 |
| 4,499,951 | A * | 2/1985 | Vann | E21B 33/12 | 166/296 |
| 4,648,470 | A | 3/1987 | Gambertoglio | | |
| 5,067,568 | A | 11/1991 | Yates et al. | | |
| 5,449,039 | A | 9/1995 | Hartley et al. | | |
| 5,558,153 | A | 9/1996 | Holcombe et al. | | |
| 6,394,184 | B2 | 5/2002 | Tolman et al. | | |
| 6,536,524 | B1 | 3/2003 | Snider | | |
| 7,635,027 | B2 * | 12/2009 | Rankin | E21B 23/08 | 166/177.4 |
| 9,121,265 | B2 | 9/2015 | Myers et al. | | |
| 2010/0051278 | A1 | 3/2010 | Mytopher et al. | | |
| 2010/0236781 | A1 | 9/2010 | Mytopher et al. | | |
| 2012/0186816 | A1 * | 7/2012 | Dirksen | E21B 7/00 | 166/297 |
| 2015/0308208 | A1 * | 10/2015 | Capps | E21B 29/08 | 166/285 |
| 2017/0175498 | A1 * | 6/2017 | Segura | E21B 33/12 | |

OTHER PUBLICATIONS

Cosad, C., "Choosing a Perforating Strategy," Oilfield Review, Oct. 1992.

Weatherford, "Tubing-Conveyed Perforating," Brochure, copyright 2013.

Int'l Search Report and Written Opinion in counterpart PCT Appl. PCT/US2016/0666673, dated Aug. 11, 2017, 11-pgs.

* cited by examiner

PUMP-THROUGH PERFORATING GUN COMBINING PERFORATION WITH OTHER OPERATION

BACKGROUND OF THE DISCLOSURE

Toe cleanout and initial perforating in a horizontal well require two complete trips to be run into the well for the separate operations and involve large costs. For example, a horizontal wellbore "toe prep" service is performed with a coil tubing operation. In this toe prep service, coil tubing deploys a fluid-activated motor downhole. The motor turns a mill to cleanout the lower section of the wellbore casing of residual cement and the like. Once cleanout is done and the equipment removed, a subsequent descent of Tubing Conveyed Perforating (TCP) equipment is then used to perforate the casing to allow for pumping into the reservoir rock. This ultimately allows operators to perform conventional plug and perforation operations.

Tubing Conveyed Perforating (TCP) equipment is the most common type of equipment used for performing toe preparation of the casing. In the perforating operation, TCP equipment consisting of one to ten guns is conveyed downhole to prepare the toe of the wellbore casing with perforations. The TCP equipment, which is nonelectric, then establishes the first perforations in the casing and can be conveyed on coil tubing or on pipe.

In the pipe-conveyed operation, multiple pressure-activated firing heads of the TCP equipment are fired at the same time and may or may not have time delays attached. Pipe tally is used to correlate the position of the TCP equipment downhole in the casing, and a packer may or may not be run to isolate the annulus. In general, such an operation can have a total trip time from about 8 to 12 hours.

In the coil tubing-conveyed operation, one pressure-activated firing head or ball-drop-differential firing head fires first in the TCP equipment. Then, time delays between gun activations can allow the coil tubing to move the TCP equipment to different zones to be perforated. In the end, the number of guns that can be run and the different zones that can be perforated may be limited by the lubricator and crane equipment at surface. The depth recorded from the clean-out run with the coil tubing can be used to correlate the position of the TCP equipment downhole to the zones to be perforated. Overall, such an operation can have a total trip time from about 6 to 10 hours.

Rather than using perforations to prepare the toe, a sliding sleeve can be attached to the casing just above the toe shoe and can be cemented in place with the casing. To establish initial fluid communication, operations can circulate a ball to shift the sliding sleeve open. At this point, opens ports on the sleeve are then in contact with the formation to allow for fluid communication used in fracturing operations and the like.

Use of such a sliding sleeve removes the need for running coil tubing or using workover rigs, and the run time of such operations can be avoided. Still, use of such a sliding sleeve produces a limited number of holes at the toe. Pressure pumping is required to open the sleeves, and the initial preparation may need to be followed by wireline pump-down perforation operations.

Importantly, if the sleeve does not operate properly or if operations are unable to establish a sufficient pump rate, operators must perform traditional TCP toe preparation anyway. Besides, cementing the sleeve offers its own challenges as operations must limit the cement sheath at the sleeve and risk over displacing the cement.

Because the first operation after cementing is normally the cleanout run on coil tubing, it would be advantageous to combine toe-prep perforating with the clean-out run. However, combining these runs is not possible with conventional explosive perforating guns and equipment. Instead, combined runs of cleanout and toe-prep perforation can be done when sand jet perforation is used. In this technique, a mill and motor are run in the casing to drill-up any residual fill and cement in the casing. Then, operations uses high-pressure jets to direct an abrasive fluid slurry to abrade holes into the casing.

Sand jet perforation may not always be useful or possible for a given implementation. If the sand jet perforating tool does not operate properly or if a sufficient pump rate cannot be established, operations must perform traditional tubing conveyed perforating (TCP) toe-prep anyway. Besides, sand jet perforation may create a limited number of holes so that wireline (WL) pump-down perforating operations may still need to be performed afterwards.

In an attempt to overcome the problems with the above techniques, a toe gun has been developed that is attached to the outside of the casing. An example of such an external toe gun is the EXternal Toe Gun (EXTG) available from Smart Completions, Ltd. The external toe gun has TCP guns mounted to the outside of the casing just above the toe shoe and are cemented in place. The guns are actuated by pressuring up the casing and bursting a rupture disc. Once activated, the gun fires in two directions—into the casing to make a flow path and away from the casing into the formation to complete the flow path.

As will be appreciated, having an external toe gun outside the casing requires a larger borehole, which carries additional drilling costs and problems. The guns must also be run at the same time as the casing. Accordingly, the guns must remain downhole longer and can become damaged.

In the end, even this technique can produce a limited number of holes so that subsequent wireline pump-down perforation may need to be done. Finally, if a gun does not fire, traditional TCP toe prep must be performed anyway.

Wellbore isolation and re-perforating in an existing well also typically require two complete trips to be run into the well for the separate operations and involve large costs. For example, a rigless workover and re-perforation service is performed with a coil tubing operation. In this rigless workover service, coil tubing deploys a fluid-activated inflatable plug. The plug fills with fluid transmitted through the tubing and seals against the completion liner or casing to isolate the lower section from the remaining wellbore. Once isolation is achieved and the equipment removed, a subsequent descent of Tubing Conveyed Perforating (TCP) equipment is then used to perforate the casing to allow for pumping into and treating and/or extraction from the reservoir rock. This ultimately allows operators to perform rigless workover, recompletion operations.

The subject matter of the present disclosure is directed to overcoming, or at least reducing the effects of, one or more of the problems set forth above.

SUMMARY OF THE DISCLOSURE

In servicing a wellbore having casing cemented therein, an assembly deploys on tubing (coiled tubing, jointed pipe, etc.) downhole. Fluid is circulated down the tubing to the assembly, and a perforating gun on the assembly passes the circulated fluid through it. A tool downhole of the perforating gun on the assembly is then operated with the circulated fluid passed through the perforating gun. For example, the tool can include a fluid-operated motor, milling tool, cutting tool, plug, packer, etc.

To allow the fluid to flow through the perforating gun, an outer housing supports the load between the tubing and operable tool and has at least one inner flow tube disposed therein. Shaped charges for perforating the surrounding casing are supported in the space between the housing and the at least one flow tube.

Once cleanup or other service is done with the tool, a detonation is initiated for perforating the casing with the charges of the perforating gun. The detonation can be initiated by a deployed device or ball shifting a sleeve to drive a pin into a detonator. Detonating cord can connect the detonation to the charges.

The foregoing summary is not intended to summarize each potential embodiment or every aspect of the present disclosure.

DETAILED DESCRIPTION OF THE DISCLOSURE

Figure 1A:
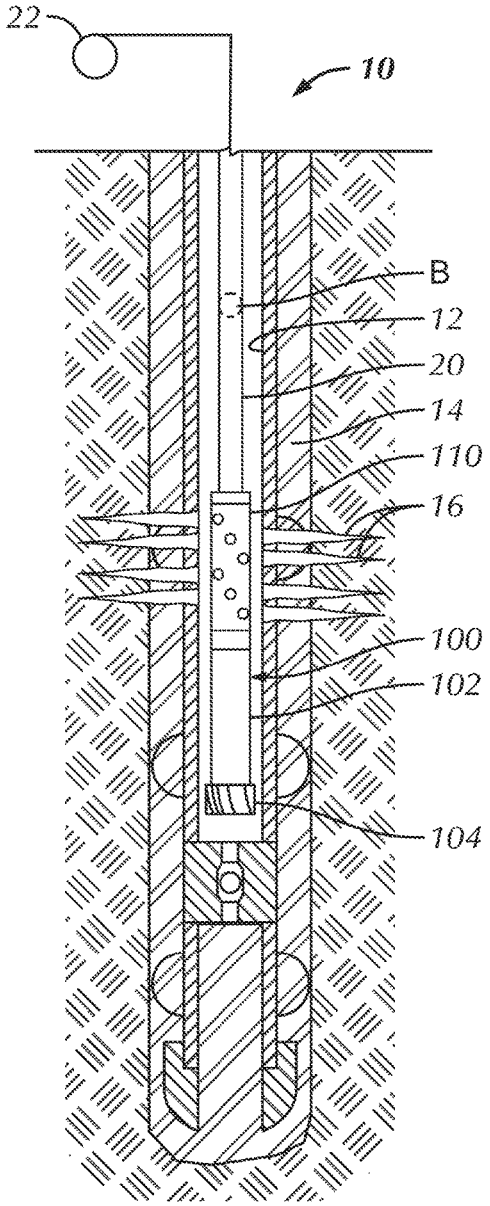
FIG. 1A illustrates a wellbore having a dual cleanout and perforating assembly deployed with a conveyance toward the toe.

FIG. 1A illustrates a wellbore 10 having a dual cleanout and perforating assembly 100 installed on a conveyance 20 toward the wellbore's toe. Although depicted vertically, the portion of the wellbore 10 toward the toe may be and would likely be horizontal. The wellbore 10 includes casing 12 cemented in place with cement 14. Once the cementing process is complete, the dual assembly 100 is deployed in the wellbore 10 using the conveyance 20, which can be coiled tubing, jointed pipe, or other conveyance. (For simplicity, reference to the conveyance 20 as tubing or coiled tubing is made herein.)

The dual assembly 100 provides for flow-through from the tubing 20 and is run in a combined operations of cleanout and toe preparation downhole in the cemented casing 12. The assembly 100 deploys a perforating gun unit 110 along with wellbore cleanout equipment on the coil tubing 20 in a single descent.

The flow-through gun unit 110 allows for the fluid-operated components of the cleanout equipment to be actively used on the same deployment. As shown in the present embodiment, the dual assembly 100 includes the perforating gun unit 110 coupled to a downhole flow-powered motor 102 and a milling tool 104. Other service equipment could be used for a flow-through service. For example, a flow-through tractor can be used for extended reach of the coiled tubing in the wellbore. Flow-through acid treatment or flow-through downhole cutters (explosive, chemical, plasma, mechanical, etc.) can be used.

When deployed, the dual assembly 100 can perform cleanout and perforating operations in the same run. Combining the two operations with the disclosed assembly 100 can lower costs and risks by minimizing the number of trips into the wellbore 10 and the time at the wellsite. The perforations from toe shoots by the gun unit 110 can be used for pump-down only or can be used for initial stage fractures. Either way, this gun unit 110 can provide the initial reservoir contact for further operations, such as plug and perforation operations.

At the surface, conveyance and pumping equipment 22 pumps fluid downhole through the coiled tubing 20. The fluid passes through the perforating gun unit 110 and operates the motor 102, which rotates the milling tool's head to clean-out the casing 12 of residual cement, cement plugs, and the like (not shown). Once cleanout operations are completed, activation communicated downhole through the coil tubing 20 then activates a firing mechanism on the perforating gun unit 110.

In one arrangement, the gun 100 uses a pressure-activated firing head that requires a certain pressure pulse or signal. In another arrangement that may be preferred, an activating devices, such as a ball B, is deployed from the surface equipment 22 down the coil tubing 20 to the perforating gun unit 110. The deployed ball B reaches the perforating gun unit 110 and activates its firing mechanism having a ball-drop-differential firing head. One or more charges on the perforating gun unit 110 then fire and form perforations 16 in the casing 12 and cement 14 to open a fluid path to the surrounding formation. Time delays between gun activations may be provided that allow the coil tubing 20 to move the perforating gun unit 110 to another section to be perforated.

Figure 1B:
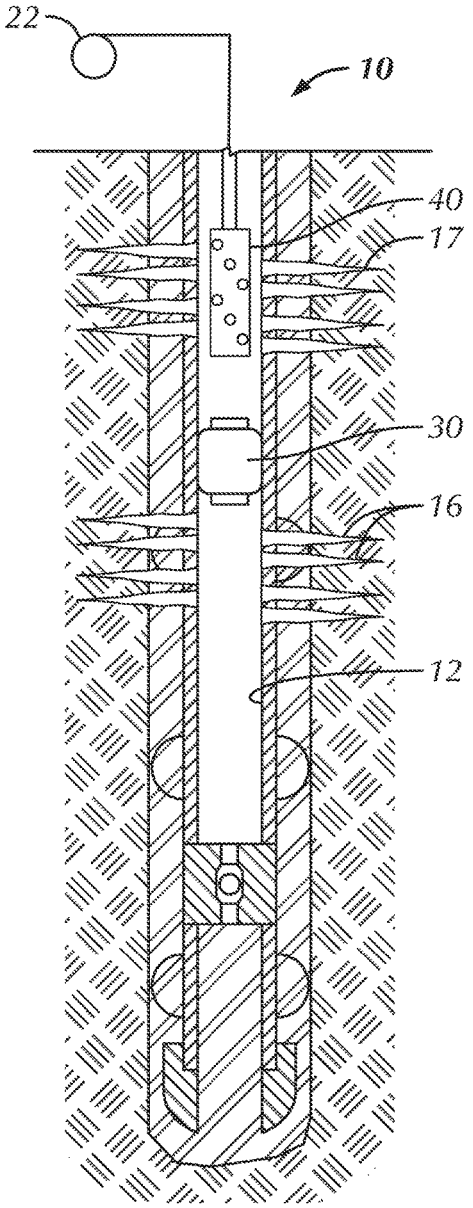
FIG. 1B illustrates the wellbore having plug and perforation equipment installed.

Once the initial perforations 16 near the toe have been established, additional operations can be performed. As shown in FIG. 1B, for example, plug and perforation equipment can be installed into the wellbore 10 to install fracture plugs 30 and produce additional perforations 17 in the casing 12 with a perforating gun 40 to perform fracture operations. As will be appreciated, this type of operation in FIG. 1B or a number of other types operations can be performed once the cleanout and toe preparation of FIG. 1A has been performed.

Figure 2A:
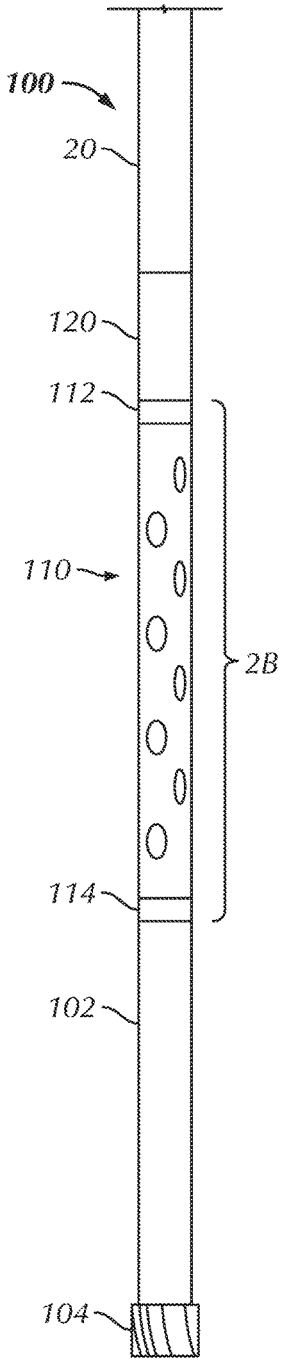
FIG. 2A illustrates an elevational view of the dual cleanout and perforating assembly of the present disclosure.
Figure 2B:
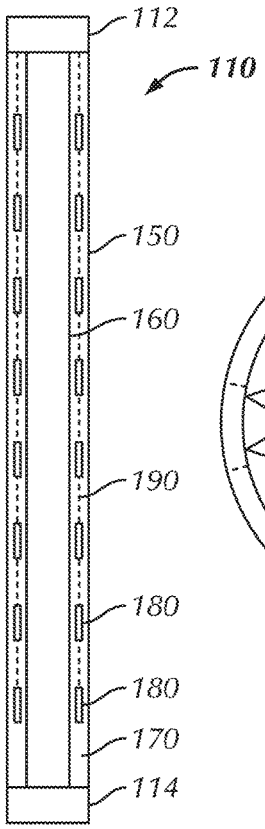
FIG. 2B illustrates an isolated schematic view of the perforating gun of the disclosed assembly.
Figure 2C:
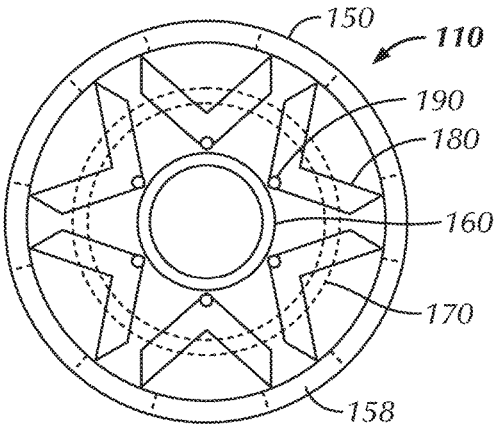
FIG. 2C illustrates a schematic end view of the perforating gun of the disclosed assembly.

Having an understanding of how the dual assembly 100 can be used, discussion turns to FIGS. 2A-2C, which illustrate additional details. As shown in the elevational view of FIG. 2A, the dual cleanout and perforating assembly 100 of the present disclosure extends from the coil tubing 20 or other conveyance. A firing mechanism 120 connects from the coil tubing 20 to the perforating gun unit 110 using an upper coupling 112. Extending from a lower coupling 114 of the perforating gun unit 110, the assembly 110 has a fluid-activated motor 102, such as a mud motor, that has a rotor and stator (not shown). When activated by pumped fluid from the coiled tubing 20 through the firing mechanism 120 and the perforating gun unit 110, the motor 102 rotates a head of the milling tool 104 for cleaning out casing.

Because fluid must pass from the coiled tubing 20 to the milling equipment of the motor 102 and milling tool 104, the perforating gun unit 110 of the disclosed assembly 100 is configured to communicate the fluid flow through it. As shown schematically in FIGS. 2B-2C, the perforating gun unit 110 has dual walls so that the assembly 100 has a through-bore for fluid passage to the additional service equipment below the gun unit 110. In particular, the internal components of the gun unit 110 include an inner flow tube 160 to allow for fluid flow through the center of the unit 110. End subs or couplings 112, 114 seal against the inner tube 160 and an outer housing of the gun unit 110.

The inner tube 160 is not a torsional or tensile loaded component. Rather, the inner tube 160 is a "free floating" seal bore that allows fluid flow through the open area inside the gun unit 110 without physical attachment on either end. On the other hand, the outer housing 150 disposed on the outside of the gun unit 110 between the end subs or couplings 112, 114 is the supporting device for the perforating gun unit 110. Shaped charges 180 of specific dimensions fit into the encapsulate area between the inner tube 160 and outer housing 150 of the flow-through gun unit 110.

In other words, the inner flow tube 160 allows for fluid flow through the perforating gun unit 110 from the upper coupling 112 to the lower coupling 114. The outer housing 150 provides the structural support between the couplings 112, 114, which correspondingly couple the coiled tubing 20 to the mud motor 102. Structurally speaking then, the outer housing 150 must bear axial and rotational loads during deployment and during cleanout operations.

The shaped charges 180 can be similar to conventional elements used in tubing conveyed perforating equipment. The charges 180 are arranged circumferentially in the annular space between the inner flow tube 160 and the outer housing 150, and various windows, scallops, or the like 158 in the outer housing 150 orient with the charges 180 to face outward toward the surrounding casing. Detonation cord 190 also fits in the annular space and couples to the charges 180. Depending on the implementation and the desired firing arrangement, one or more strands of such detonation cord 190 can be used and can have time delays incorporated between various charges 180.

To support the charges 180, a plenum material or support 170 in the form of a sleeve is disposed in the annular space between the inner flow tube 160 and the outer housing 150. The sleeve 170 holds the charges 180 in position and orientation. In one embodiment, this supportive sleeve 170 can be composed of a high-density foam with preconfigured cutouts, pockets, and the like for positioning the shaped charges 180 and for accommodating detonating cord 190.

Figure 3A:
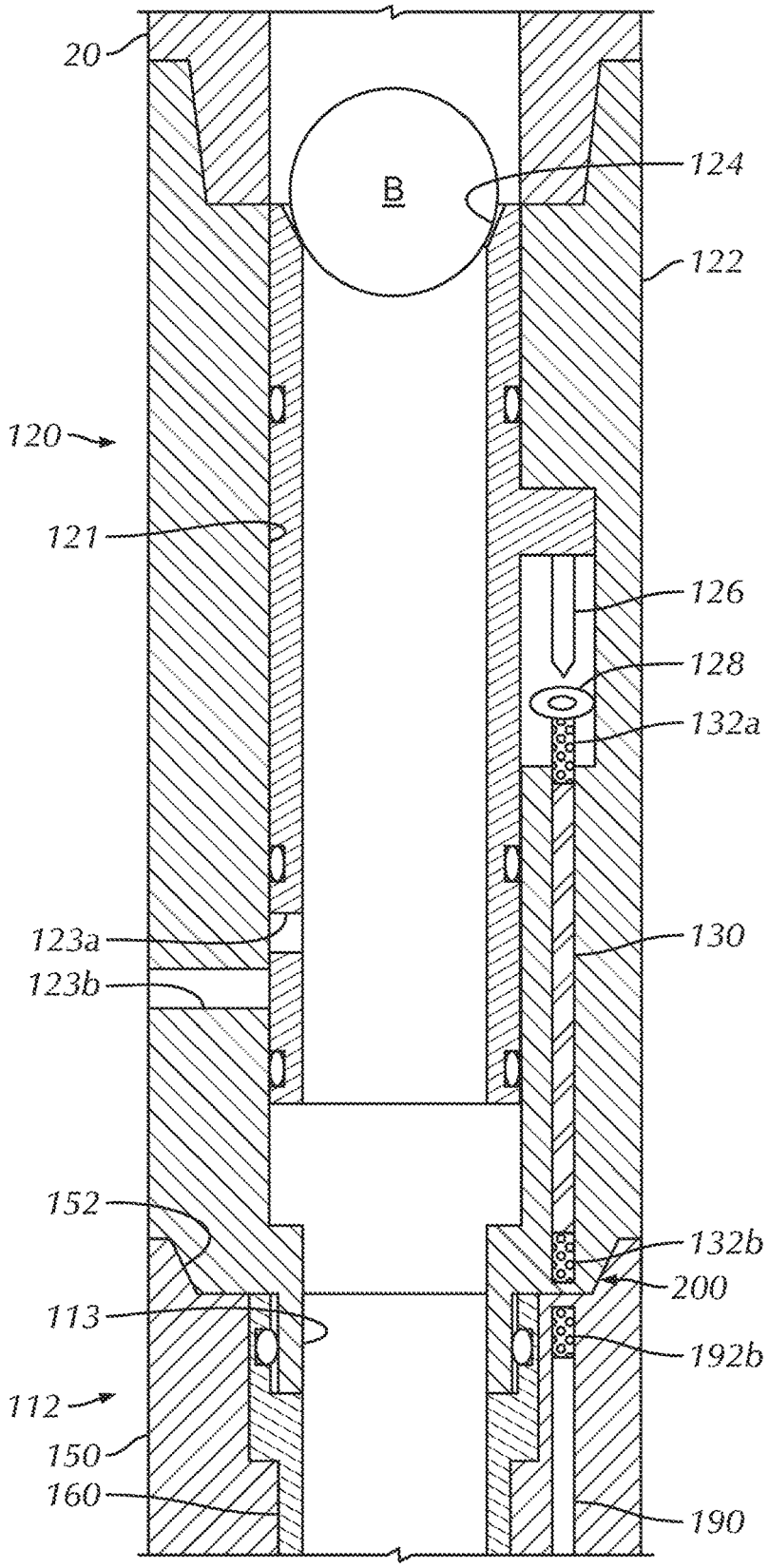
FIGS. 3A-3B illustrate cross-sectional views showing the perforating gun of the disclosed assembly in more detail.
Figure 3B:
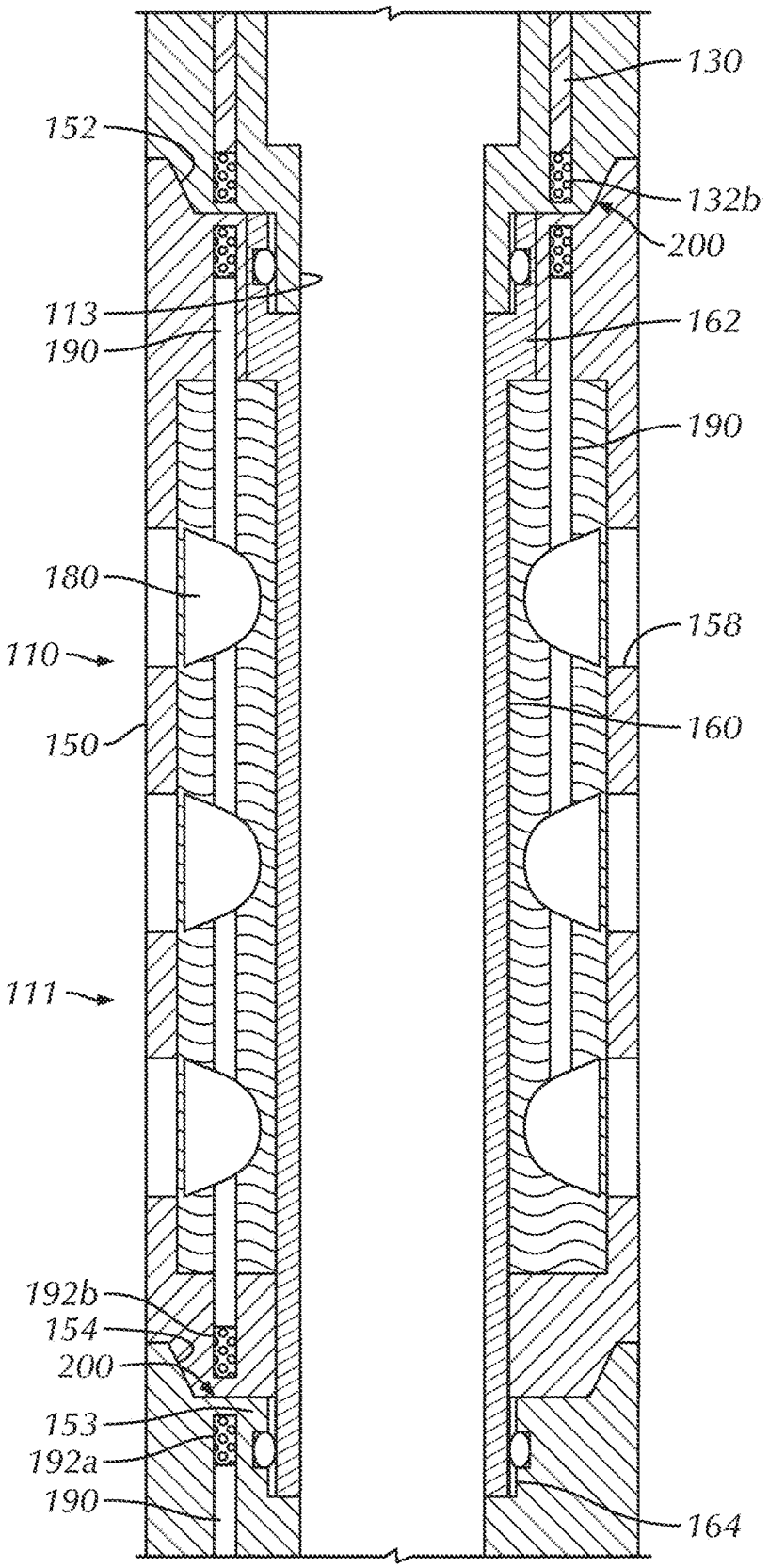

Having at least a general understanding of the dual assembly 100, discussion turns to FIGS. 3A-3B, which illustrate even more details of the assembly 100 in cross-section. FIG. 3A primarily shows features of a firing mechanism 120 for the disclosed assembly 100, while FIG. 3B primarily shows features of a gun section of the disclosed assembly 100.

The firing mechanism 120 connects from the coil tubing 20 to the perforating gun unit 110 at the upper coupling 112. As shown here, the firing mechanism 120 has a ball-drop-differential firing head. A movable sleeve 122 disposed in the mechanism's bore 121 has a seat 124 for engaging a deployed device or ball B. After pumping services are completed for cleanout operations, the ball B deployed into the coil tubing 20 circulates to the ball seat 124. The ball B seals at the seat 124, and the force from pressure behind the seated ball B activates the firing mechanism 120.

For example, when the ball B engages the seat 124 and fluid pressure from the tubing 20 is applied, the sleeve 122 shifts down. One or more firing pins 126 moved by the sleeve 122 then drive into one or more detonators 128 to begin initiation of the firing. The shift downward of the pins 126 can strike the detonator 128 with a required amount of force (e.g., 10 ft-lbs) to start an initiation chain. Although one arrangement is depicted here, preferably a redundant set of firing pins 126, detonators 128, and the like are provided. A detonator support 132*a* supports the detonator 128 and connects to a detonator cord 130.

The sleeve 122 also includes one or more outlets 123*a* that can align with circulating ports 123*b* in the firing mechanism 120 with shifting of the sleeve 122. In this way, the sleeve 122 can shift further to allow circulation through the external ports 123*b*.

Once firing is initiated, the detonation can be transferred to the gun unit 110. The detonator 128 initiates the detonating cord 130, and an explosive pellet or ballistic booster 132*b* transfers a ballistic force downward into the gun unit 110 and initiates the detonating cord booster 192 within the gun unit 110. The sleeve 122 also shifts downward enough to open the circulating port 123*b* and allow flow around the coil tubing 20. Time delay devices can be incorporated via hydraulic diversion or incendiary charges to allow a given delay time for detonation and adjustment of pressure on the wellbore prior to detonation.

To transfer the detonation at the coupling 112 of the firing mechanism 120 to the upper section of the perforating gun unit 110, the detonation cord 130 has the detonating booster 132*b* that transfers the detonation across the interface of the coupling 112 to an opposing detonating booster 192*a* on a detonation cord 190 of the perforating gun unit 110. The boosters 132*b*, 192*a* can be bidirectional booster charges, such as typically used between strings of perforating guns. Although not specifically shown here, a ballistic transfer system 200 can be used at the interface to transfer the detonation from the upper booster 132*b* to the opposing booster 192*a*. Such a ballistic transfer system 200 is discussed further below with reference to FIG. 4.

As noted above, the firing mechanism 120 before deployment of the ball B allows fluid flow therethrough from the tubing 20 to the perforating gun unit 110 so the fluid can pass further to operate the motor, milling tool, etc. downhole from the perforating gun unit 110. Accordingly, the internal bore 121 of the firing mechanism 120 communicates directly with the perforating gun unit 110 at the coupling 112. For the connection at the coupling 112, a threaded interface 152 connects the outer housing 150 to the firing mechanism 120 so that axial and rotational support is made between the components. (For simplicity, features associated with end rings, cylindrical sleeves, thread, seals, and the like between the housing 150 and the coupling 112 are not shown, but would be present to accommodate assembly of the perforating gun unit 110.

A swedged sealing interface 113 can be used at the coupling 112 of the firing mechanism 120 to the perforating gun's inner flow tube 160, which is primarily used for fluid communication and not structural support. The interface 113 preferably has a swedged, telescopic, or stabbed type of sealing arrangement. As shown, the swedged sealing interface 113 folds over and around to allow the upper end of the flow tube 160 to seal in the upper coupling 112 of the housing 110. Various seals, such as O-rings or the like, can engage between a widened opening at the coupling 112 and an expanded end of the tube 160. In this way, fluid from the firing mechanism's bore 112 extended into the expanded end of the flow tube 160 can pass into the flow tube 160 for further travel to other downhole components, such as the motor (102) and the like. Structurally, the arrangement at the coupling 112 and the interface 113 tends to hold the flow tube 160 axially, but the structural loads of the housing 110 are not transferred to the flow tube 160.

Turning now to FIG. 3B, the features of a section 111 of the perforating gun 110 are depicted extending from the firing mechanism 120 at the coupling 112. At a lower coupling 114, the section 111 can connect to another such section (111), to the motor (102), or to some other downhole component. In general, the section 111 can have any desired length, and a given implementation may have several such sections 111 connected longitudinally together between the firing mechanism 120 and other downhole components.

As noted above, the perforating gun unit 110 includes the outer housing 150 through which the inner flow tube 160 passes. The annular space between them contains the shaped charges 180 arranged longitudinally and/or circumferentially on the gun unit 110. The charges can be arranged in varying phases and shot densities depending on the configuration of the flow-through in the unit 110.

To support the charges 180, the annular space has the supportive sleeve 170 noted above disposed therein. Windows 158, scallops, slick exterior, or the like on the outer housing 150 can allow the charges 180 to face outward toward surrounding casing (not shown). For example, the exterior of the outer housing 150 can be slick (i.e., not altered from round), and the outer housing 150 can have windows that allow fluid from the outside, in a configuration with encapsulated perforating charges. The one or more detonation cords 190 pass from adjacent the firing mechanism 120 to the charges 180. A section of such a detonation cord 190 can pass to further sections 111 of the gun unit 110 if used.

For the connection at the upper coupling 112, the threaded interface 152 connects the outer housing 150 to the firing mechanism 120 so that axial and rotational support is made between the components. Also, the swedged sealing interface 113 is used at the coupling 112 of the firing mechanism 120 to the perforating gun's inner flow tube 160, which is primarily used for fluid communication and not structural support. In this way, fluid from the firing mechanism's bore can pass into the flow tube 160 for further travel to the motor (102) and the like.

For the connection at the lower coupling 112 of the section 111 to another section or other component, another threaded interface 154 connects the outer housing 150 thereto so that axial and rotational support is made between the components. Also, a swedged sealing interface 153 is used at the coupling 114 for the perforating gun's inner flow tube 160, which is primarily used for fluid communication and not structural support. In this way, fluid from the section 110 can pass from the flow tube 160 for further travel to the other downhole components to receive and use the fluid flow.

This swedged sealing interface 153 allows the lower end of the flow tube 160 to seal in the lower coupling 114 of the housing 110. Various seals, such as O-rings or the like, can engage between a widened opening at the coupling 114 and an end of the tube 160 stabbed into the coupling 114. In this way, fluid from the flow tube 160 can pass further to travel to other downhole components. Structurally, the arrangement at the coupling 114 tends to hold the flow tube 160 axially, but the structural loads of the housing 110 are not transferred to the flow tube 160.

If the section 111 of FIG. 3B couples to a further section 111 downhole, for example, then another ballistic transfer arrangement 200 can be used at the coupling 114. Otherwise, no further communication of the detonation may be needed.

In general, the coupling 114 can thread to a number of components in addition to or instead of a motor and mill assembly. For example, the coupling 114 can connect to another flow-through firing head for additional gun components, a flow-through tandem sub for an additional gun, a flow-through time delay, a flow-through vent sub, a flow-through auto release, a flow-through setting tool, a flow-through packer, a flow through cutter (e.g., jet, plasma, chemical, etc.), and the like.

As noted above, gun initiation can be performed through a dual impact detonator system and dual cord/booster transfer through a surface booster transfer arrangement. To do this, transfer of the detonation from the firing mechanism 120 must pass the interface from the mechanism 120 to the perforating gun unit 110 and may need to pass between coupled sections 111 of the perforating gun unit 110. To achieve this transfer, a ballistic transfer system 200 as illustrated in a cross-sectional view of FIG. 4 can be used for the disclosed assembly. The ballistic transfer system 200 includes a disk 202 of ballistic material disposed at the seal face between the coupled components, which in this example are the firing mechanism 120 and the gun housing 150.

Figure 5A:
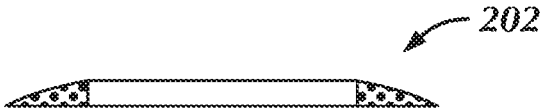
FIGS. 5A-5B illustrate side and plan views of a ballistic disk for the transfer arrangement in FIG. 4.
Figure 5B:
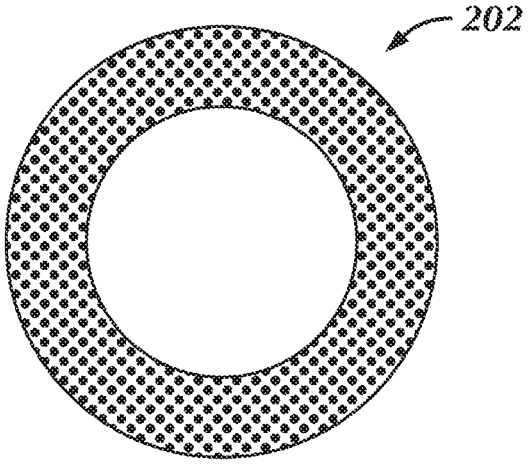

FIGS. 5A-5B illustrate side and plan view of the ballistic disk 202. The shape of the disk 202 helps ensure that the detonation from the detonating cord 130, such as in the firing mechanism 120, can align with the detonating booster 192*a* of the perforating gun 110 on the other side of the connection.

Figure 4:
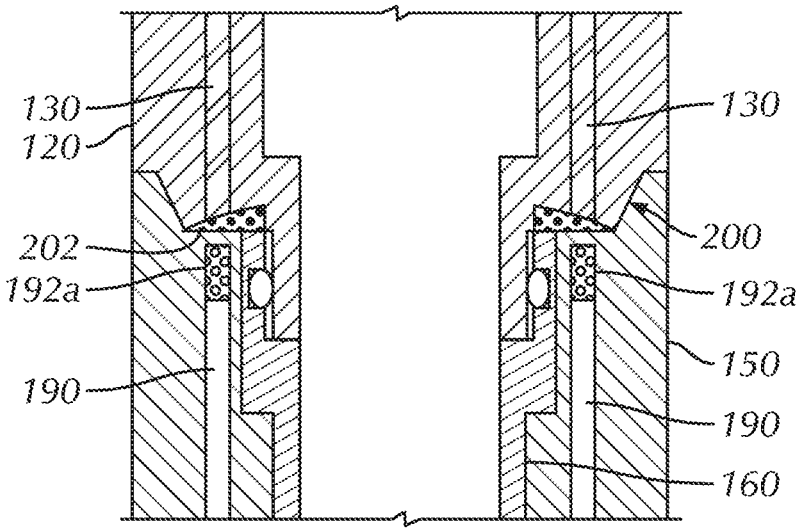
FIG. 4 illustrates a cross-sectional view of a ballistic transfer arrangement for the disclosed assembly.

In the arrangement of FIG. 4, the ballistic disk 202 can be held behind metallic material at the seal face for the connection, as can the detonating booster. The thin layer of the metallic material can enable suitable connection and sealing between the components, but would allow the detonation to breach across from the ballistic disk 202 to the booster 192*a*.

Figure 6A:
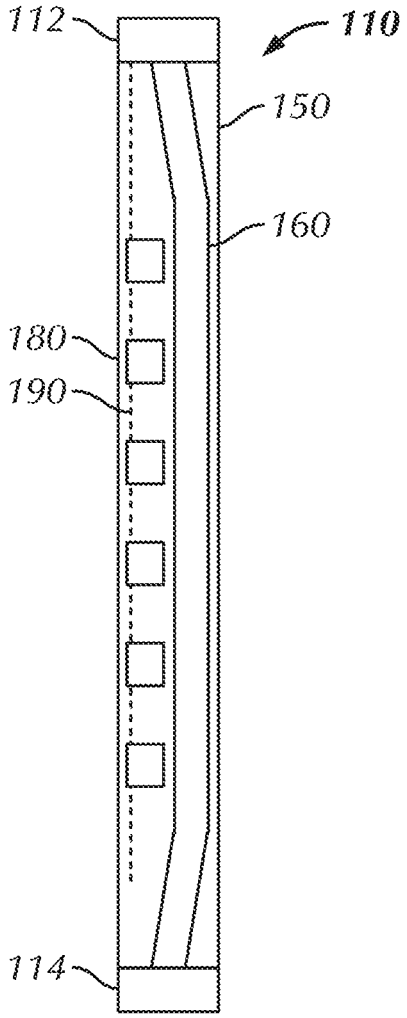
FIGS. 6A-6B illustrate isolated schematic views of the perforating gun unit of the disclosed assembly with different flow-through tube arrangements.
Figure 6B:
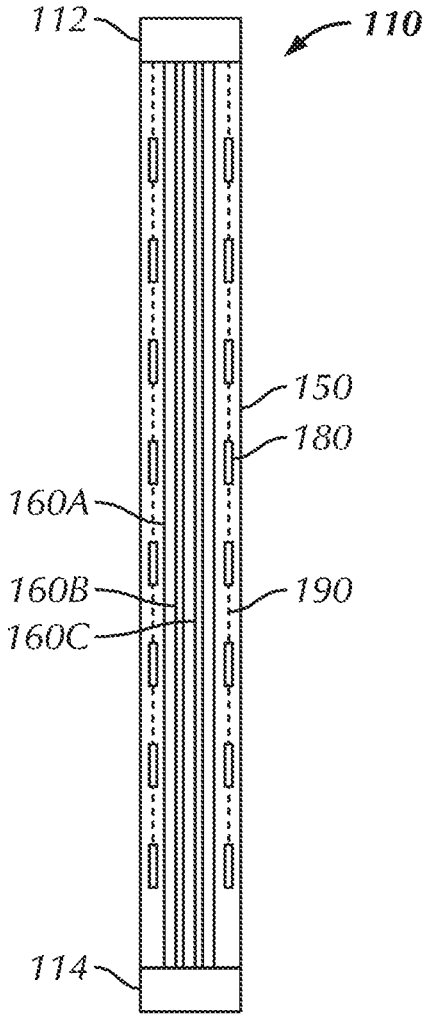

In previous embodiments, the flow tube 160 has been generally centralized in the outer housing 150. This is not strictly necessary, and other configurations can be used. For example, FIGS. 6A-6B illustrate isolated schematic views of the perforating gun unit 110 of the disclosed assembly with different flow-through arrangements. In FIG. 6A, a pump-through tube 160 is bent, curved, contoured, or the like and can be at least partially located against one interior side of the outer housing 150. This can allow larger perforating charges 180 to be positioned in the hollow space in the rest of housing 150.

In FIG. 6B, pump-through of the unit 110 uses several smaller tubes 160A-C dispersed through the interior of the housing 150 between and/or around the charges 180. These smaller tubes 160A-C, which can also be bent and the like, carry the volume of fluid necessary to operate the equipment below the coupling 114. This configuration can allow for spiral phased charges 180 of a larger net explosive weight to be used in the gun unit 110.

As may be the case, shaped charges that produce limited depths of perforation may need to be used in the gun unit 110 due to the existence of the flow tube(s). However, this may be of less concern because the unit 110 may be run in a toe preparation operation. Namely, wider perforations and not necessarily deeper perforations may be suitable for toe preparation.

Figure 7A:
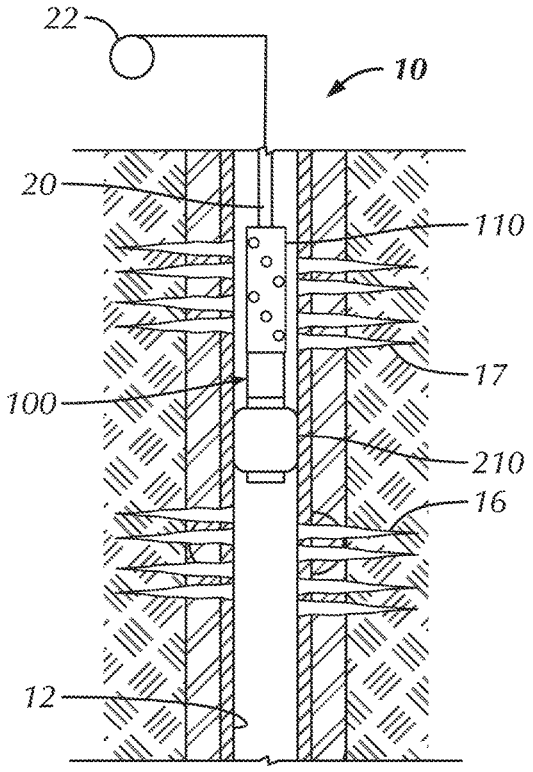
FIG. 7A illustrates a wellbore having a dual isolation and perforating assembly deployed with a conveyance.

In previous embodiments, the disclosed assembly 100 has been used for a dual cleanout and perforating operation. As already noted, other operations can benefit from the teachings of the present disclosure in which perforating is performed in the same run as another operation downhole of the gun unit 110 that uses the flow-through provided. For example, FIG. 7A illustrates a wellbore 10 having a dual isolation and perforating assembly 100 deployed with a conveyance 20. This assembly 100 is used for wellbore isolation and re-perforating in the existing wellbore 10, which may have already been perforated with perforations 16. In a rigless workover and re-perforation service, the assembly 100 deploys on coil tubing 20 from surface equipment 22 and includes a fluid-activated, well isolation device 210 downhole from a perforating gun unit 110. The well isolation device 210 can be an inflatable plug or a conventional packer activated by fluid.

When the desired depth is reached in the casing 20 or liner, pumping from the surface equipment 22 down the tubing 20 passes through the flow-through of the plug unit 110 to the fluid-activated isolation device 210. Having known components of valves, ports, and the like, the isolation device 210, if an inflatable plug, fills with the fluid transmitted through the tubing 20 and pump unit 110. Other well isolation devices can be used, such as a hydraulically-set compression packer, bridge plug, etc. The activated isolation device 210 seals against the completion liner or casing 12 to isolate the lower section from the remaining wellbore 10.

Once isolation is achieved, the Tubing Conveyed Perforating (TCP) equipment of the gun unit 110 is then used to perforate the casing 12 with additional perforations 17 to allow for pumping into and treating and/or extraction from the reservoir rock. The perforating gun unit 110 can be disengaged from the isolation device 210 using a shearable coupling or the like, and a well perforation and treatment can be performed on the same descent, saving an additional trip in the well. A casing patch operation can be performed in essentially the same way. Generally speaking, the flow through gun unit 110 can be coupled with any number of fluid/hydraulic-operated tools and mechanisms.

Figure 7B:
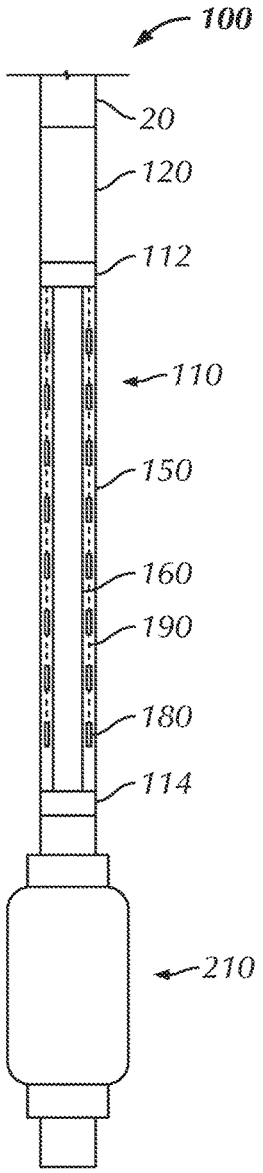
FIG. 7B illustrates an elevational view of the dual isolation and perforating assembly of the present disclosure.

FIG. 7B illustrates an elevational view of the dual assembly 100 for performing the isolation and perforating as in FIG. 7A. Many components of the assembly 100 are similar to previous embodiments so like reference numerals are used. The dual isolation and perforating assembly 100 extends from the coil tubing 20 or other conveyance. A firing mechanism 120 connects from the coil tubing 20 to the perforating gun unit 110 using an upper coupling 112. Extending from a lower coupling 114 of the perforating gun unit 110, the assembly 100 has a fluid-activated inflatable plug 210.

When activated by pumped fluid from the coiled tubing 20 through the firing mechanism 120 and the perforating gun unit 110, the plug 210 inflates to isolate the wellbore. Because fluid must pass from the coiled tubing 20 to the plug 210, the perforating gun unit 110 is configured to communicate the fluid flow through it. Accordingly, the perforating gun unit 110 has an outer housing 150, an inner flow tube 160, end couplings 112 and 114, detonating cord 190, charges 180, and other components as disclosed herein.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly deployed on tubing to service and perforate casing downhole in a wellbore, the assembly comprising:

a perforating gun coupled to the tubing and having a flow passage therethrough communicating fluid from the tubing;

a firing mechanism defining a bore in fluid communication with the tubing, the firing mechanism defining a circulating port communicating with the bore, the firing mechanism comprising a sleeve movably disposed in the bore in response to an activation from fluid pressure communicated against a deployed device engaged in a seat of the sleeve, the sleeve being movable relative to the circulating port to control fluid communication of the bore with the circulating port, the moved sleeve driving a pin into a detonator and initiating a detonation in response thereto;

one or more charges disposed on the perforating gun, the one or more charges being exploded to perforate the casing in response to the detonation; and a tool coupled downhole from the perforating gun and being operable with the fluid communicated from the tubing through the flow passage of the perforating gun.

2. The assembly of claim 1, wherein the tool comprises a well isolation device coupled downhole from the perforating gun and being operable with the communicated fluid to isolate a portion of the wellbore.

3. The assembly of claim 1, wherein the tool comprises a motor coupled downhole from the perforating gun and being operable with the communicated fluid.

4. The assembly of claim 1, wherein the tool comprises a milling tool coupled downhole from the perforating gun and being operable with the communicated fluid.

5. The assembly of claim 1, wherein the firing mechanism comprises a first ballistic transfer coupled to the detonator with a first detonating cord and disposed at a first connection of the firing mechanism to the perforating gun, the first ballistic transfer transferring the detonation across the first connection.

6. The assembly of claim 5, wherein the first ballistic transfer comprises a detonating booster coupled to the first detonating cord and disposed at the first connection.

7. The assembly of claim 6, wherein the detonating booster comprises a disc of booster material disposed about a seal face at the first connection between the firing mechanism and the outer housing.

8. The assembly of claim 5, wherein the perforating gun comprises a second ballistic transfer receiving the detonation across the first connection and comprises a second detonating cord extending from the second ballistic transfer and communicating the detonation to the one or more charges.

9. The assembly of claim 8, wherein the second ballistic transfer comprises a detonating booster coupled to the second detonating cord and disposed at the first connection.

10. The assembly of claim 8, wherein the perforating gun comprises more than one section coupled longitudinally together at second connections, each section having a portion of the flow passage, each section having first and second ballistic transfers transferring the detonation across the second connections.

11. The assembly of claim 1, wherein the perforating gun comprises an outer housing having at least one flow tube disposed therein for the flow passage communicating fluid from the tubing, the at least one flow tube in fluid communication with the bore of the firing mechanism.

12. The assembly of claim 11, wherein the one or more charges are disposed in an inner space between the outer housing and the at least one flow tube.

13. The assembly of claim 12, comprising an intermediate sleeve disposed in the inner space between the outer housing and the at least one flow tube and supporting the one or more charges.

14. The assembly claim 11, wherein the at least one flow tube comprises a first swedged seal toward the fluid communication from the tubing; and a second swedged seal toward the tool.

15. The assembly of claim 1, wherein the open circulating port allows flow around the tubing.

16. An assembly deployed on tubing to clean and perforate casing downhole in a wellbore, the assembly comprising:

a housing defining an inner space and having first and second ends, the first end coupled to the tubing;

at least one flow tube disposed in the inner space of the housing and communicating fluid from the tubing at the first end to the second end of the housing;

a firing mechanism defining a bore in fluid communication with the tubing, the firing mechanism defining a circulating port communicating with the bore, the firing mechanism comprising a sleeve movably disposed in the bore in response to an activation from fluid pressure communicated against a deployed device engaged in a seat of the sleeve, the sleeve being movable relative to the circulating port to control fluid communication of the bore with the circulating port, the moved sleeve driving a pin into a detonator and initiating a detonation in response thereto;

one or more charges disposed in the inner space between the housing and the at least one flow tube, the one or more charges being exploded in response to the detonation to perforate the casing; and a tool coupled toward the second end of the housing and in communication with the fluid from the at least one flow tube, the tool being operable with the communicated fluid.

17. A method of servicing a wellbore having casing cemented therein, the method comprising:

deploying an assembly on tubing downhole in the casing of the wellbore;

circulating fluid down the tubing to the assembly;

passing the circulated fluid through a perforating gun on the assembly;

operating a tool downhole on the assembly from the perforating gun with the circulated fluid passed through the perforating gun;

activating a firing mechanism with a deployed device circulated down the tubing to the assembly, the firing mechanism defining a circulating port communicating with the bore, by moving a sleeve movably disposed in a bore of the firing mechanism with fluid pressure against the deployed device seated in the sleeve, the sleeve being movable relative to the circulating port to control fluid communication of the bore with the circulating port, and driving a pin with the movement of the sleeve into a detonator to initiate a detonation for the perforating gun; and perforating the casing with one or more charges of the perforating gun in response to the detonation.

18. The method of claim 17, wherein operating the tool comprises isolating a portion of the wellbore.

19. The method of claim 17, wherein operating the tool comprises operating a motor coupled downhole from the perforating gun.

20. The method of claim 17, wherein the operating the tool comprises milling with the operation of the tool.

21. The method of claim 17, wherein initiating the detonation for the perforating gun further comprises opening a circulating port to circulate the tubing with the wellbore.

22. The method of claim 17, wherein perforating the casing with the one or more charges of the perforating gun in response to the detonation comprises transferring the detonation across a connection of the perforating gun to the assembly with a ballistic transfer coupled to the detonator and communicating the transferred detonation to the one or more charges with at least one detonating cord.

23. The method of claim 17, wherein passing the circulated fluid through the perforating gun on the assembly comprising supporting the one or more charges in an inner space between an outer housing and at least one inner flow tube of the perforating gun.

24. The method of claim 23, wherein passing the circulated fluid through the perforating gun on the assembly comprises communicating the circulated fluid through the at least one inner flow tube having swaged seals on its ends communicating with the tubing and the tool.

25. The method of claim 17, comprising allowing flow around the tubing through the open circulating port.

* * * * *